United States Patent [19]

Mullins et al.

[11] Patent Number: 4,535,326

[45] Date of Patent: Aug. 13, 1985

[54] LINER DETERIORATION WARNING FOR FLUID MOVERS

[75] Inventors: Lance A. Mullins, Colorado Springs, Colo.; Michael A. Self, Rockland, Calif.

[73] Assignee: Joy Manufacturing Company, Pittsburgh, Pa.

[21] Appl. No.: 400,566

[22] Filed: Jul. 21, 1982

[51] Int. Cl.[3] ..... G08B 21/00; F01B 25/26

[52] U.S. Cl. ..... 340/679; 73/86; 406/35; 415/118; 415/197; 417/63

[58] Field of Search ..... 73/86; 340/52 A, 540, 340/679; 416/61; 417/63; 92/170; 415/118, 197; 324/71.2; 406/35

[56] References Cited

U.S. PATENT DOCUMENTS

| | | | |
|---|---|---|---|
| 2,166,404 | 7/1939 | Hait | 417/63 |
| 2,981,929 | 4/1961 | Rizzo et al. | 340/52 A |
| 3,271,737 | 9/1966 | Bezemek | 340/52 A |
| 3,546,691 | 12/1970 | Smith | 417/63 |
| 3,716,832 | 2/1973 | Gorgie et al. | 340/52 A |
| 3,914,752 | 10/1975 | Howard et al. | 417/63 X |
| 4,183,012 | 1/1980 | Kimura | 340/52 A |
| 4,234,291 | 11/1980 | Hurst et al. | 415/197 X |
| 4,328,462 | 5/1982 | Jensen | 73/86 X |

FOREIGN PATENT DOCUMENTS

| | | | |
|---|---|---|---|
| 19527 | 11/1980 | European Pat. Off. | 73/86 |

*Primary Examiner*—James L. Rowland
*Assistant Examiner*—Brian R. Tumm
*Attorney, Agent, or Firm*—Edward L. Levine

[57] ABSTRACT

Method and apparatus for detecting deterioration of a replaceable liner in a pump transporting an electrically conductive fluid medium. A conductive component is isolated, during normal operation, from the conductive fluid medium by the electrically insulative liner. The conductive component is positioned at a predetermined location relative to the liner such that upon a selected degree of wear of the liner, an electrical circuit is completed upon contact of the fluid medium and the conductive member.

10 Claims, 8 Drawing Figures

LINER DETERIORATION WARNING FOR FLUID MOVERS

FIELD OF THE INVENTION

This invention relates to detection of wear of liners within components of fluid systems, and more particularly to early detection of deterioration of electrically non-conductive liners within a mover such as a pump.

BACKGROUND OF THE INVENTION

Movers such as pumps, compressors, blowers, fans and other apparatus for transporting harsh fluid mediums, and particularly abrasive and corrosive liquids, pneumatic mixtures or slurries, are well known to utilize so called "soft" liners to protect the integrity of the casings and other interior components exposed to the deteriorating environment produced by the fluid medium being transported. The liners typically provided are composed of materials such as natural and synthetic rubbers, neoprene and other elastomeric materials which have demonstrated good wearing quality under such harsh operating conditions.

Although such movers operate well for their intended purposes, and extend the operational life of the mover, periodic inspection, maintenance and replacement of the soft liners is made. Because such liners are completely or at least substantially contained within the mover, the liners are inaccessible during normal operation and hence the degree of deterioration is not readily ascertainable. Accordingly, the movers are often operated until local deterioration of the liner is so substantial that a non-scheduled shutdown must be made. Such shutdowns, not being planned in advance, can result in highly detrimental down time and inconvenience to the operator, and interference with the process system within which the mover is operating. Furthermore, even with scheduled maintenance shutdowns, such liners are oftentimes replaced prior to completion of useful life, in order to avoid the deleterious affects of future unscheduled shutdowns. This results in less than optimum use of the liners, and unnecessary costs in terms of purchase and inventory requirements of liners. It is therefore desirable to provide a manner in which to extend the useful life of such liners which preferably will alleviate unpredictable and unsatisfactory down time.

SUMMARY OF THE INVENTION

This invention provides systems for determining deterioration of a liner of a mover transporting a harsh fluid medium. Use of the system indicates to an operator a preselected degree of wear of the liner so that scheduled maintenance and replacement can be performed. The invention is useful in any mover for transporting a fluid medium which contains sufficient capacity to transmit an electrical current. It is particularly useful for movers such as pumps which are utilized to transport corrosive or abrasive fluid mediums.

In a preferred form a soft liner of an electrically insulating material such as rubber is formed in a desired shape for attachment within a mover such as a pump. The rubber liner is preferably bonded or otherwise affixed to a metallic supportive plate. A particular example of existing use of a liner - plate subassembly is the fastening of the subassembly to the suction side inlet of a centrifugal pump such as that marketed by the Denver Equipment Division of Joy Manufacturing Company, Colorado Springs, Colo. 80903, under the trademark SRL. The rubber liner is electrically non-conductive, and is bonded to the surfaces of a metallic back plate which otherwise would be exposed to abrasive fluid mediums being pumped. The liner-back plate subassembly is affixed to the suction side of the pump casing through four studs which contact, but preferably do not extend through, the plate.

The metallic back plate is electrically isolated from the pump casing and incidental moisture. This is preferably accomplished by covering the exposed portion of the plate, that is, that portion of the plate not bonded directly to the liner, with a coating material such as a sprayed plastic. A portion of the stud extending outwardly from the liner, through the pump casing, is also sprayed for electrical isolation from the portion of the casing through which it passes. Additionally, a non-conductive washer is positioned between the pump casing and a mounting nut on the stud. A non-conductive cap nut is affixed over the stud and the nut, against the non-conductive washer. In this manner each mounting is electrically isolated from the pump casing and the fluid being transported, and is in electrical communication with the metallic back plate.

At least one of the multiple mountings is provided with an electrical lead preferably mounted in contact with the stud by a spring mounted within the cap nut. Thus, the insert and mountings are electrically isolated from the pump casing and the fluid medium, and are electrically connected to a single lead external to the pump. Part of the isolation is provided by the rubber liner which is in direct contact with the fluid medium.

The electrical lead is connected to a monitoring and indicator system, including an electrical power source and an alarm such as a light. The indicator system includes another lead which is in electrical communication with the conductive fluid medium, for example, being sandwiched between the metallic pump casing inlet flange and the flange of a mating conduit, which flanges are in direct contact with the fluid medium.

When, during operation, the rubber liner deteriorates to the extent that the fluid medium directly contacts the back plate, an electrical circuit is completed and the alarm indicates to the operator that liner replacement should be scheduled. The complete circuit includes the conductive fluid, the insert, the stud, the first lead, the alarm and power source, and the second lead back to the conductive fluid, and can also include an actuator switch. With this embodiment the operator has preselected the degree of liner deterioration which signals the alarm to be total local deterioration through the liner. It is equally possible to extend or embed an electrical conductor within the liner at a selected depth, to signal an alarm when a preselected amount of liner deterioration has occurred and a selected amount of the liner is still totally intact. For example, the insert can be provided with protrusions which extent into the rubber liner at a position where a high degree of wear is expected. Additionally, the liner can be fabricated with a conductor embedded at a selected depth, such as a wire mesh, which is electrically connected to the stud directly, or through a conductive lead.

With or without utilization of a structural back plate, a liner can be placed in electrical communication with a conductive structure which is insulated from the balance of a mover and positioned to signal contact of the fluid medium and the conductive structure upon a preselected degree of liner deterioration.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 1:
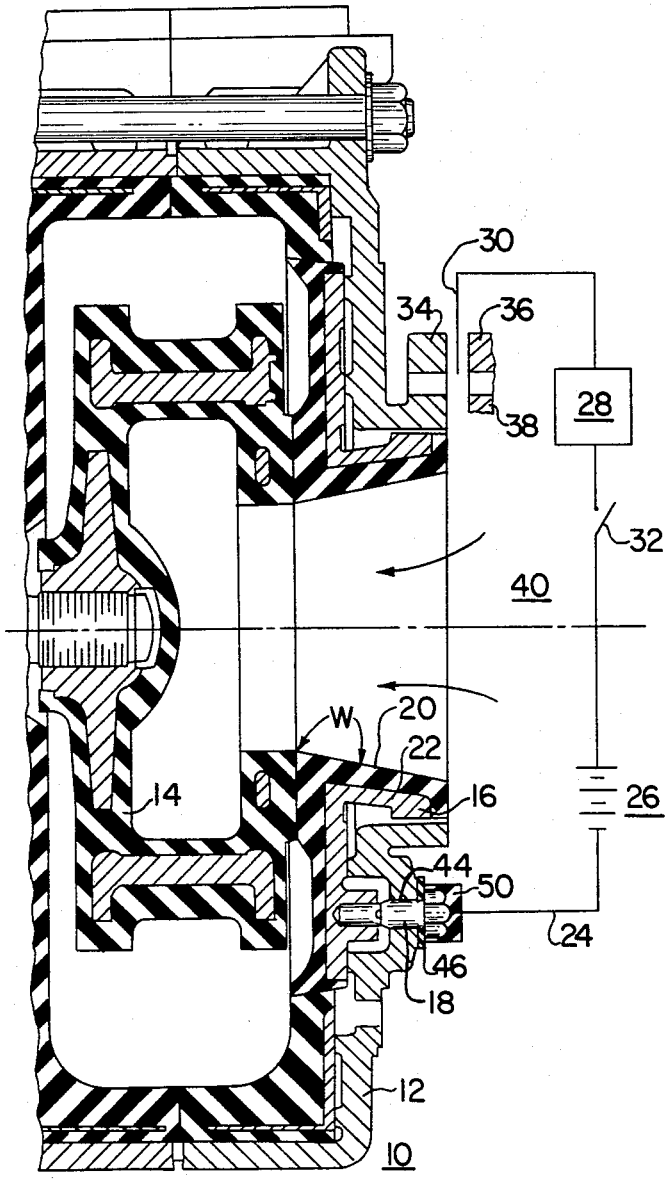
FIG. 1 is a sectional view of the suction inlet of a centrifugal pump including a liner wear detection system in accordance with the invention.

Referring now to FIG. 1 there is shown a portion of an exemplary mover such as the inlet suction section of a pump 10. The pump 10 includes a metallic casing 12. The exemplary pump 10 shown includes an impeller 14 which includes a soft exterior of a material such as rubber, neoprene or other elastomeric materials. Soft materials, as opposed to most metals, are particularly useful where harsh abrasive or corrosive fluid mediums are being transported by a mover. A soft liner subassembly 16 is removably affixed within the casing 12 by a plurality of studs 18. The liner subassembly 16 typically includes a soft liner 20 and a metallic backing plate 22. In accordance with the invention, the liner 20 can be affixed within the pump 10 with or without the backing plate 22. The entire liner 20, or a selected portion thereof, is comprised of an electrically non-conductive material such as the elastomeric materials commonly in use.

The liner subassembly 16 is electrically isolated from the metallic, electrically conductive pump casing 12, as described further hereinafter, and is in direct contact with the fluid medium being pumped. At least one of the studs 18 is electrically interconnected to the backing plate 22, and to a first lead 24. The lead 24 communicates with an indicating subsystem including an electrical power source 26, a monitoring device 28, and a second lead 30. A switch 32 can also be utilized. The second lead is in electrical communication with the fluid medium being moved, for example, being sandwiched between a flange 34 of the conductive pump casing 12 and a mating flange 36 of a conductive conduit 38 which attaches to the casing 12.

It is known that particularly when harsh fluid mediums are pumped, for example a slurry of particulate ore in water, the liner 20 will deteriorate over a period of time, and can wear through to a degree at which the fluid medium is in direct contact with the backing plate 22. Wear is common at the regions denoted by the letter W on FIG. 1.

It will now be recognized that as long as the backing plate 22 is electrically insulated from a conductive fluid medium, a circuit 40 through the monitoring device 28 cannot be completed. However, upon sufficient deterioration such that an electric current can be carried from the fluid medium through the backing plate 22, the monitoring 28 device can be actuated. The completed circuit includes the conductive fluid medium, the backing plate 22, the stud 18, the first lead 24, the power source 26, the switch 32, the monitoring device 28, the second lead 30, and the flanges 34, 36, back to the fluid medium. Completion of the circuit 40 thus evidences liner wear. The simplified circuit shown is among many that will be evident to those skilled in the art, and can include well known amplifiers and signal conditioners. The system can also be made responsive to selected frequencies to alleviate the possibility for spurious wear indications.

Figure 2:
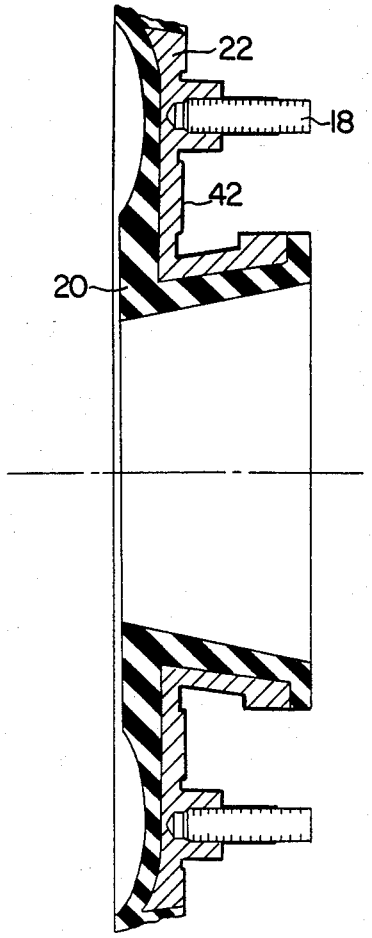
FIG. 2 is a section view of one embodiment of a liner assembly mounted to a pump casing in accordance with the invention.
Figure 3:
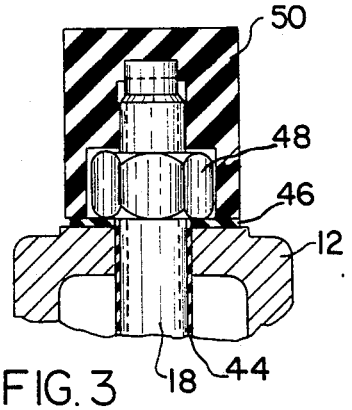
FIGS. 3 and 4 are sectional views of a mounting to a pump casing in accordance with the invention.
Figure 4:
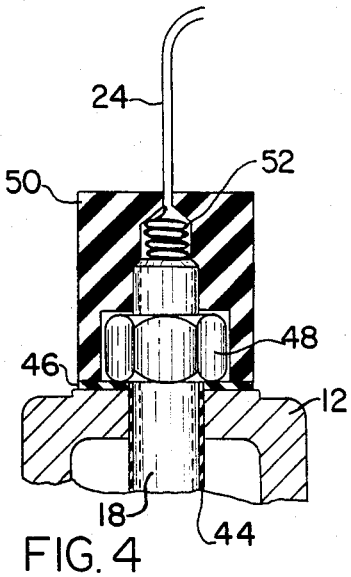

FIGS. 2, 3 and 4 show a preferred construction for electrically isolating the backing plate 22 from a conductive fluid medium and pump casing 12. As shown particularly in FIG. 2, the insulative liner 20 is configured and bonded to the conductive backing plate 22 in a manner which isolates the plate 22 on those exterior surfaces which likely could be exposed to the fluid medium during normal pump operation. This configuration is common on many existing pumps. Additionally, however, a non-conductive coating 42, which is preferably also moisture resistent, is applied to the remaining external surfaces of the backing plate 22. It has been found that a 0.04 to 0.06 inch thick layer of Sinclair-Rush Air Dry Plastic Coating, commercially available from Sinclair and Rush, Inc. of St. Louis, Mo., is well suited to the desired application. Any coating used will preferably be electrically insulative, flexible in situ so as to create a good seal, easy to apply such as by dipping or spraying, and moisture proof. A portion of bores which are matingly configured to receive the studs 18 can also be coated. A conductive path is made available between the backing plate 22 and stud 18 in the embodiment of FIG. 2. The liner 20 and coating 42 thus effectively encapsulate the backing plate 22 in an insulative enclosure. The encapsulation can also be achieved by fabricating the liner subassembly 16 in a manner whereby the elastomeric liner material surrounds the exterior of the backing plate 22, thus eliminating the need for the separate coating 42.

As shown best in FIGS. 3 and 4, the studs 18 can also be insulated from the pump casing 12 by insulative cylindrical inserts 44 and a non-conductive washer 46. Sprayed layers of non-conductive materials can also be utilized on selected surfaces of the casing 12 and the studs 18. The studs 18 preferably thread into the backing plate 22 at their forward end, and are loaded against the casing 12, through the insulative washers 46, by a standard mounting nut 48. The other end of the stud 18, and the nut 48, is enclosed by a non-conductive cap nut 50 sealingly fitted against the washer 46. A typical pump 10 of the exemplary type will include four mounting assemblies, of which three will be of the type shown in FIG. 3.

At least one stud mounting assembly is constructed as shown in FIG. 4, whereby the stud 18 is electrically interconnected to the first lead 24. A conductive metallic coil spring 52 is connected to the first lead 24, and is biased to seat against the stud to ensure good electrical contact.

Figure 5:
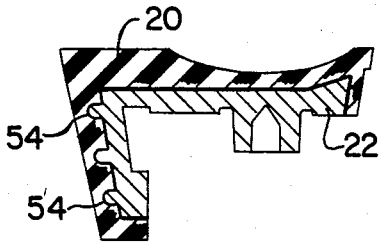
FIGS. 5 through 8 are sectional views showing alternate embodiments of liners and conductors in accordance with the invention.

The above-described system will alert an operator to deterioration of the soft liner 20 to the extent that the liner 20 is completely worn at a location where the fluid medium directly contacts the backing plate 22. Other constructions can be utilized whereby a preselected degree of liner wear, short of complete wear-through to the body of the backing plate, can be signaled. The embodiment shown in FIG. 5 includes protrusions 54 on the backing plate 22 which extend a preselected distance into the body of the liner 20. A protrusion 54 sized and positioned to, for example, complete the electrical circuit 40 when ten percent of the useful life of the liner is remaining, will allow an operator to schedule maintenance for liner replacement without the need for immediate or premature shutdown. Preferably any such protrusion 54 will wear at a rate equal to or greater than that of the liner 20.

Figure 6:
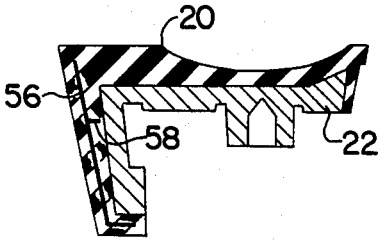

FIG. 6 shows a configuration wherein a conductive harness 56 of a conductive material, such as a metallic mesh or woven fiber is embedded at a preselected position within the liner 20 during molding. The harness 56 is placed in electrical communication with the backing plate 22 through a conductive wire 58. It is preferred that such harness or any other conducting means embedded in the liner wear at a rate equal to or greater than that of the liner when exposed to the harsh fluid medium.

Figure 7:
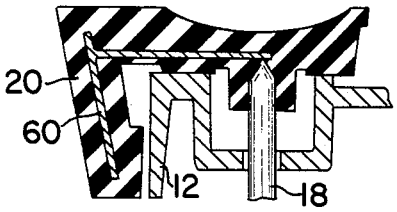

FIG. 7 shows an embodiment wherein no backing plate is utilized. The liner 20 includes an internal support 60 of a conductive material embedded within the liner at a preselected depth. An electrical conduction path is established between the support 60 and a position external of the pump casing 12, for example through the stud 18. The support 60 here functions as a structural as well as a conduction member.

Figure 8:
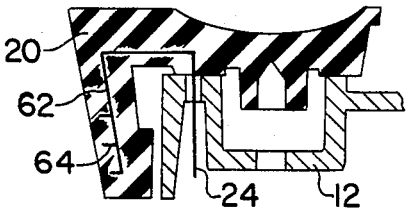

It will be recognized that many other configurations are possible which provide a conducting means contiguous with a preselected position within or at an external surface of the liner. The liner, or a non-conductive insert to the liner, insulates the conducting means, such as the protrusions, the harness, plural wires or other shapes, from the pump casing and the fluid medium during initial operation. Many other means for conducting a current from adjacent a selected section of the liner to a position outside of the pump, in addition to the preferred stud arrangement, are equally possible, and will be readily apparent to those skilled in the art. In FIG. 8, the lead 24 is connected to a wire 62 which includes plural stubs 64 extending to selected positions within the non-conductive liner.

The monitoring device 28 is of any conventional design by which the operator of the mover desires to receive an indication of liner wear. It can include, for example, means for providing a signal indicative of the predetermined degree of liner deterioration, and means responsive to the signal for alerting the operator of the deteriorated condition, such as a light. Audible and/or visual alarms can be incorporated. It is contemplated that a solid state control module providing an indicating signal, including for example, an amplifying means, can be incorporated directly into the non-conductive cap nut 50.

It will be apparent that the liner deterioration warning system disclosed may be modified for usage in pumping and moving apparatus in many fashions without departing from the spirit of the disclosed invention. Other pump components, in addition to the inlet casing, can advantageously utilize the system. Liner wear detection systems of the type disclosed are useful in any fluid system moving a conductive fluid medium or a medium which is made sufficiently conductive through use of a conductive seed material. It will also be apparent that the detection system and method are useful in many types of movers and other fluid system components. It therefore is to be understood that the foregoing description of preferred forms of the invention as applied particularly to a pump, is to be taken as illustrative, and not in a limiting sense. With regard to the particular type of pump illustrated, it will be noted that the system can advantageously be incorporated with minimal modification to existing components.

We claim:

1. A system for transporting an electrically conductive fluid medium, comprising:

a pump having a primary metallic casing through which a fluid is transported, said casing configured to removably receive an electrically non-conductive liner configured to overlay a substantial portion of the interior of said casing:

means, including a conductive member disposed within said casing, contiguous with said liner and electrically insulated from said fluid medium, for providing an electrical signal indicative of wear through a portion of said liner, said wear placing said conductive member into direct electrical contact with said electrically conductive fluid medium; and means for providing an alarm in response to said signal.

2. In a pump for transporting an electrically conductive fluid medium, said pump having a primary metallic casing through which said fluid medium is transported, said casing being configured to removably receive an electrically non-conductive liner configured to overlay a substantial portion of the interior of said casing, a system for indicating wear through a portion of said liner comprising:

means, including a conductive member contiguous with said liner an electrically insulated from said fluid medium at least in part by said liner, for providing an electrical signal indicative of said wear, said wear placing said conductive member into direct electrical contact with said electrically conductive fluid medium; and means response to said signal for providing an alarm.

3. In a pump for moving an electrically conductive fluid medium, said pump being of the type having an electrically non-conductive liner portion removably affixed within a metallic casing and configured to overlay a substantial portion of the interior of said casing, said fluid medium being transported through said casing, a system for indicating wear of said liner portion comprising:

an electrical circuit including a current responsive indicator disposed external of said casing; and means, including a conductive member disposed within said casing and contiguous with said liner portion and electrically insulated from said fluid medium, for conducting an electric current through said indicator in response to a preselected degree of wear of said liner portion which places said conductive member into direct electrical contact with said electrically conductive fluid medium.

4. In a mover for transporting an electrically conductive harsh fluid medium, said mover having a wearable electrically non-conductive liner portion, apparatus for detecting a preselected degree of deterioration of said liner portion. comprising:

conducting means, including a metallic backing plate affixed to said liner portion and having protrusions extending into said liner portion, contiguous with a preselected position of said liner portion for conducting an electrical current:

wearable means, composed at least in part of said liner portion for electrically insulating said conducting means from said conductive fluid medium;

a conductor in electrical communication with said conductive fluid medium; and means disposed at least partially external of said mover in electrical communication with said conducting means and said conductor for detecting a current flow through said conducting means upon sufficient wear of said liner portion so as to provide electrical contact of said fluid medium and said conducting means.

5. The mover of claim 4 wherein said conducting means comprises a fastening component.

6. In a mover for transporting an electrically conductive harsh fluid medium said mover having a wearable electrically non-conductive liner portion, apparatus for detecting a preselected degree of deterioration of said liner portion, comprising:

conducting means, including a wire embedded a preselected distance into said liner portion, contiguous with a preselected position of said liner portion for conducting an electrical current:

wearable means, composed at least in part of said liner portion, for electrically insulating said conducting means from said conductive fluid medium;

a conductor in electrical communication with said conductive fluid medium; and means disposed at least partially external of said mover in electrical communication with said conducting means and said conductor for detecting a current flow through said conducting means upon sufficient wear of said liner portion so as to provide electrical contact of said fluid medium and said conducting means.

7. In a mover for transporting an electrically conductive harsh fluid medium, said mover having a wearable electrically non-conductive liner portion, apparatus for detecting a preselected degree of deterioration of said liner portion, comprising:

conducting means, including a conductive mesh embedded within said liner portion, contiguous with a preselected position of said liner portion for conducting an electrical current;

wearable means, composed at least in part of said liner portion, for electrically insulating said conducting means from said conductive fluid medium;

a conductor in electrical communication with said conductive fluid medium; and means disposed at least partially external of said mover in electrical communication with said conducting means and said conductor for detecting a current flow through said conducting means upon sufficient wear of said liner portion so as to provide electrical contact of said fluid medium and said conducting means.

8. A replaceable liner subsystem for a pump for transporting an electrically conductive fluid medium including a liquid comprising:

said liner subsystem including an electrically insulative liner sized and configured for attachment within said pump in contact with said fluid medium, said liner being attached within said pump and having contiguous therewith at a preselected position means for conducting an electrical current external of said pump, said conducting means including a conductive insert having a conductive surface adjacent said liner and a non-conductive coating encapsulating the balance of said insert.

9. The subsystem of claim 8 wherein said coating is impermeable to moisture.

10. The subsystem of claim 8 wherein said coating is impermeable to said fluid medium.

* * * * *

UNITED STATES PATENT AND TRADEMARK OFFICE

CERTIFICATE OF CORRECTION

PATENT NO. : 4,535,326

DATED : August 13, 1985

INVENTOR(S) : Mullins et al

It is certified that error appears in the above-identified patent and that said Letters Patent are hereby corrected as shown below:

Column 6, line line 33 delete "an" and substitute -- and --.

Signed and Sealed this

*Eighteenth* Day of *February 1986*

[SEAL]

*Attest:*

DONALD J. QUIGG

*Attesting Officer*

*Commissioner of Patents and Trademarks*